US009988757B2

(12) United States Patent
John et al.

(10) Patent No.: US 9,988,757 B2
(45) Date of Patent: Jun. 5, 2018

(54) ACCOMMODATING DEVICE FOR A REMOVABLE FILTER IN A DOMESTIC APPLIANCE

(71) Applicant: BSH BOSCH UND SIEMENS HAUSGERÄTE GmbH, München (DE)

(72) Inventors: Alexander John, Berlin (DE); Martin Korte, Berlin (DE)

(73) Assignee: BSH Hausgeräte GmbH, München (DE)

( * ) Notice: Subject to any disclaimer, the term of this patent is extended or adjusted under 35 U.S.C. 154(b) by 406 days.

(21) Appl. No.: 14/404,719

(22) PCT Filed: May 22, 2013

(86) PCT No.: PCT/EP2013/060521
§ 371 (c)(1),
(2) Date: Dec. 1, 2014

(87) PCT Pub. No.: WO2013/178517
PCT Pub. Date: Dec. 5, 2013

(65) Prior Publication Data

US 2015/0144748 A1 May 28, 2015

(30) Foreign Application Priority Data

May 30, 2012 (DE) ..... 10 2012 209 124

(51) Int. Cl.
*D06F 58/22* (2006.01)
*D06F 58/24* (2006.01)
(Continued)

(52) U.S. Cl.
CPC ..... *D06F 58/22* (2013.01); *D06F 33/00* (2013.01); *D06F 58/24* (2013.01)

(58) Field of Classification Search
CPC ..... D06F 58/22; D06F 58/24; D06F 39/10
(Continued)

(56) References Cited

U.S. PATENT DOCUMENTS 3,378,934 A * 4/1968 Erickson ..... D06F 58/22 34/82
7,159,833 B2 * 1/2007 Kato ..... H04M 1/0237 248/292.13
(Continued)

FOREIGN PATENT DOCUMENTS

CN 101153445 A 4/2008
CN 101173482 A 5/2008
(Continued)

OTHER PUBLICATIONS

International Search Report for PCT/EP2013/060521 dated Nov. 18, 2013.
(Continued)

*Primary Examiner* — Tan Le
(74) *Attorney, Agent, or Firm* — Nixon & Vanderhye, P.C.

(57) ABSTRACT

The invention relates to an accommodating device for a removable filter in a domestic appliance, having an accommodating opening for accommodating the filter at least in part, and having a seal which, with the filter inserted, seals the accommodating opening in relation to the filter. In order for fluff, hair and other deposits and contaminants both adhering to the filter and deposited in the vicinity of the accommodating opening to be reliably kept away from the accommodating opening when the filter is being removed, the seal is arranged at the accommodating opening and has at least one sealing element which, when the filter is being removed, passes out of a sealing operating position into a
(Continued)

Figure 1:
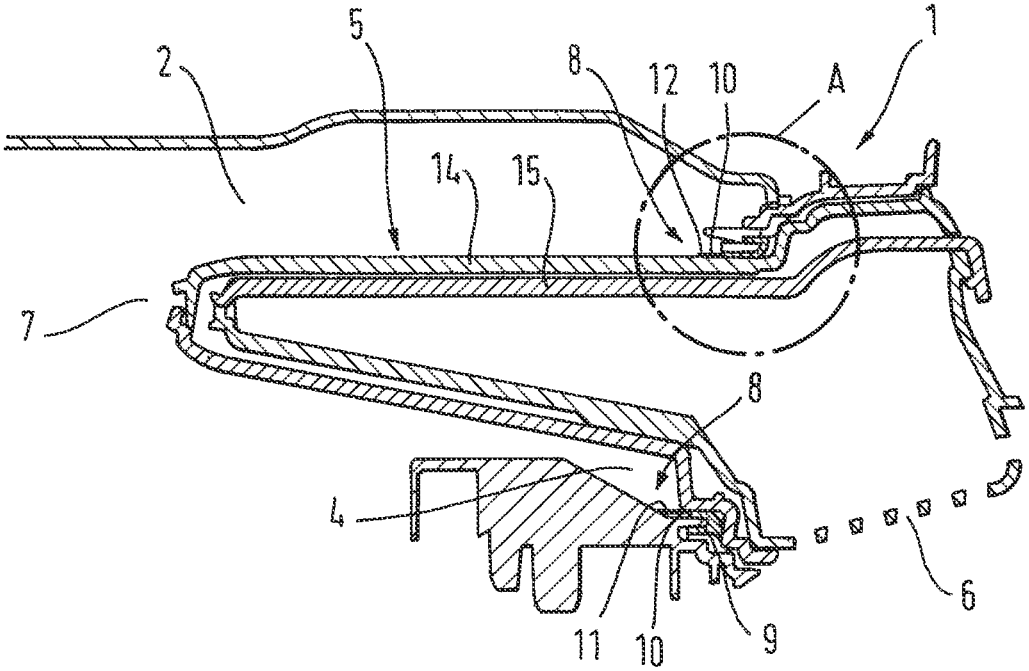

screening position, in which it encloses at least part of the accommodating opening with screening action.

25 Claims, 2 Drawing Sheets

(51) Int. Cl.
*D06F 33/00* (2006.01)
*D06F 39/10* (2006.01)
*F26B 25/00* (2006.01)

(58) Field of Classification Search
USPC ..... 248/94; 34/82, 130, 595, 597; 55/482, 55/490, 493, 400; 68/12.16
See application file for complete search history.

(56) References Cited

U.S. PATENT DOCUMENTS

2003/0172689 A1* 9/2003 Fitton ..... D06F 39/14 68/12.26
2004/0216326 A1* 11/2004 Kitamura ..... D06F 25/00 34/597
2008/0110042 A1* 5/2008 Ackermann ..... D06F 58/18 34/487
2015/0144748 A1* 5/2015 John ..... D06F 58/22 248/94

FOREIGN PATENT DOCUMENTS

| | | | |
|---|---|---|---|
| DE | 33 04 441 | | 8/1984 |
| DE | 40 23 129 | | 1/1992 |
| DE | 19613298 | C1 | 7/1997 |
| EP | 2 230 349 | | 9/2010 |
| EP | 2 392 724 | | 12/2011 |
| GB | 2134635 | A | 8/1984 |
| JP | 2008-099804 | | 5/2008 |
| JP | 2011-167221 | A | 9/2011 |

OTHER PUBLICATIONS

Written Opinion of the ISA for PCT/EP2013/060521 dated Nov. 18, 2013.
International Preliminary Report on Patentability for PCT/EP2013/060521 dated May 16, 2014.

* cited by examiner

ACCOMMODATING DEVICE FOR A REMOVABLE FILTER IN A DOMESTIC APPLIANCE

This application is the U.S. national phase of International Application No. PCT/EP2013/060521 filed 22 May 2013 which designated the U.S. and claims priority to DE Patent Application No. 10 2012 209 124.6 filed 30 May 2012, the entire contents of each of which are hereby incorporated by reference.

The invention lies in the area of domestic appliances, such as in particular tumble dryers, washer/dryers or other devices in which deposits arising as a result of operation, such as lint, hairs or other contamination, are filtered out by a filter or a filter element. In many such devices it is necessary for the filter to be able to be removed from the device for cleaning purposes or for maintenance purposes.

The invention relates to an accommodating device for a removable filter which is disposed in a process air duct of a domestic appliance, with an accommodating opening to at least partly accommodate the filter and with a seal which, with the filter inserted, seals the filter in relation to the opening.

Numerous accommodating devices for filters in domestic appliances are known, which are optimized in accordance with various aspects. Thus DE 197 45 091 A1 describes a lint filter device for an electric tumble dryer, which is held on the loading door and which has an inhibiting or blocking element which prevents the tumble dryer being put into operation if the removable fine filter body of the filter is inserted incorrectly or is missing.

DE 33 04 441 A1 discloses a lint filter device for a domestic tumble dryer which prevents lint penetrating into the outlet air duct through lack of sealing between the filter frame and the shaft frame. To this end a frame component of the filter is provided on its air inlet side with a seal surrounding the filter material and resting against the shaft frame from inside and the insertion mechanism of the lint filter is embodied narrowing down in stages.

DE 197 56 708 C2 relates to a tumble dryer with a lint filter device which is disposed removably in the closure door of the tumble dryer, wherein the process air flow initially flows through a main filter surface and then through a secondary filter surface essentially arranged at right angles to the main filter surface.

WO 2011/061068 A1 relates to a dryer with essentially closed guidance of the process air which flows through a first removable lint filter. Details in respect of the removal of the lint filter are not discussed in this document.

US2003/0154618 A1 describes a separate cleaning device for easily and conveniently removing lint adhering to the mesh of a lint filter of a tumble dryer for the user. To do this the user removes the lint filter from the accommodating device disposed in the process air duct of the tumble dryer and inserts the mesh filter into a waste container of the separate cleaning device accessible through a receiving slot. When the mesh filter is subsequently removed from the container, wiping elements disposed around the receiving opening cause lint adhering to the filter screen to be removed and held back in the container.

EP 0 443 361 A1 relates to a fluff filter monitoring device which prevents the loading door being closed and thus the laundry drier being put into operation until the fluff filter is inserted into the accommodating device. To this end a lug is provided on the loading door which engages into an assigned recess when the door is closed. When the fluff filter is correctly inserted into the accommodating device, the filter slides into a closing element, which has a flat wall section which is dimensioned slightly larger than the cross-section of the process air duct. The closing element also has a flat slider part which extends at right angles to the wall section and, through the pre-tensioning of a torsion spring, blocks the entry path for the lug of the loading door. On removal of the fluff filter the closing element slides out on the side wall of the filter.

DE 196 13 298 C1 and DE 20 2007 014 571 U1 each disclose an accommodating device for a removable filter of a domestic appliance of the type described at the start.

The device known from DE 196 13 298 C1 for a domestic tumble dryer provides a sealing lip on the lower frame arm of the lint filter which, together with further filter-side elements, forms a storage dish, which is taken out together with the filter when the filter is cleaned. The storage dish catches any lint falling from the filter disks when the filter is removed. When the lint filter is taken out of the accommodating opening this prevents lint and small particles held back falling into the process air duct and being able to adversely affect the drying process.

DE 20 2007 014 571 U1 describes a filter, especially for tumble dryers for capturing the lint and fluff created during a drying process with a filter medium made of plastic disposed in a frame which is disposed in the drying air lines sealed by means of the seal so that it can be removed and reinserted. In this case the frame of the filter is formed by the seal itself, which is connected permanently to the filter medium.

With the aforementioned embodiments it is largely insured that lint already located on the lint filter or other contaminations cannot get into the accommodating opening and thus for example into a process air circuit during removal of the filter. However sufficient account has not yet been taken of the problem of lint, hairs and/or small particles being able to accumulate in the immediate vicinity of a lint filter, which could get into the accommodating opening in an undesired way when the filter is removed.

Against this background, the object of the present invention is to insure that, on removal of the filter, lint, hair and other deposits and contaminations adhering both on the filter side and also in the vicinity of the accommodating opening can be reliably kept away from the accommodating opening.

Advantageous embodiments of the invention emerge from the subsequent description, and the accompanying drawing, the features of which can be employed individually or in any given combination.

This object is thus achieved in accordance with the invention for an accommodating device of the type described at the start by the seal being disposed on the accommodating opening side and having at least one sealing element, which moves on removal of the filter from a sealing operating position into a screening position, in which it surrounds at least one part of the accommodating opening in the manner of a screen.

Through the inventive design of the seal or of the active sealing element (sealing lips) it is insured that on removal of the filter, lint, hair or other contaminations or even small objects to be handled in the domestic appliance (for example small laundry items) are securely prevented from falling into the accommodating opening. Thus the said items cannot get into the accommodating opening and cannot lead to the operation of the device being adversely affected.

In the screening position (with the filter removed) the lint and contamination held back can be easily taken out or removed. It can however also be insured (e.g. by the geometrical design of the seal or of the sealing element, for example by corresponding brims or by a flanged edge), that the lint and contaminations held back, when the filter is reinserted, slide along the outer surfaces of the filter for example such that the contamination cannot be forced into the accommodating opening even during reinsertion of the filter.

A particular aspect of the invention consists of the seal disposed on the accommodating opening side automatically moving or being transferred from its sealing operating position into the screening position on removal of the filter. This can be achieved by a mechanical drive, by spring elements or especially preferably also by the geometrical or elastic design of the sealing elements or the sealing lips respectively.

An especially advantageous embodiment of the invention in this connection makes provision for the sealing element to have at least one sealing lip able to be hinged from the operating position into the screening position.

In accordance with a likewise especially advantageous development of the invention in this connection, the sealing element has at least one elastic sealing lip which adjusts itself when the filter is removed.

Thus the kinetic energy required for placing the seal or its sealing element into the screening position is provided by the elasticity of the sealing lip. In particular the sealing lip, during insertion of the filter, can be bought or hinged against its own spring pre-tensioning into the operating position. This enables the seal especially preferably to have a hingable sealing lip or a hingable sealing web. Preferably the seal can be made at least partly of an elastomer for this purpose.

A preferred embodiment of the invention in terms of manufacturing and installation technology makes provision for the seal to be a two-component part with a sealing element which consists of an elastomer and with an installation area which is made of another material. This means that the seal is able to be independently optimized in its properties—namely in respect of the sealing properties by the elastomer material and in respect of its fastening properties by the other material (for example a thermoplastic material).

Especially preferred in terms of installation is a development of the invention such that the installation area has at least one latching element with which the seal is fastened on the accommodating opening side.

Figure 2:
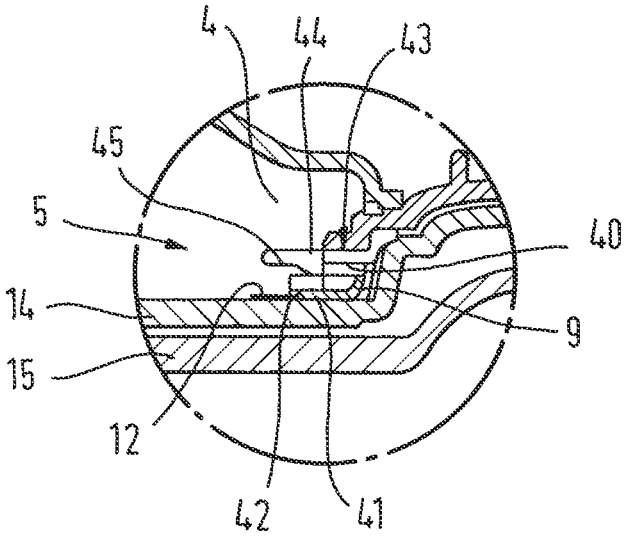
Figure 3:
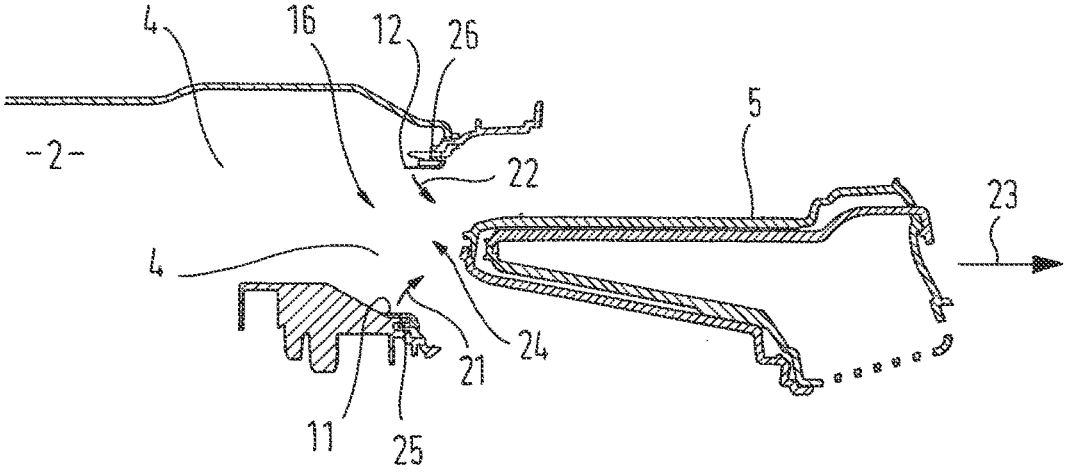
Figure 4:
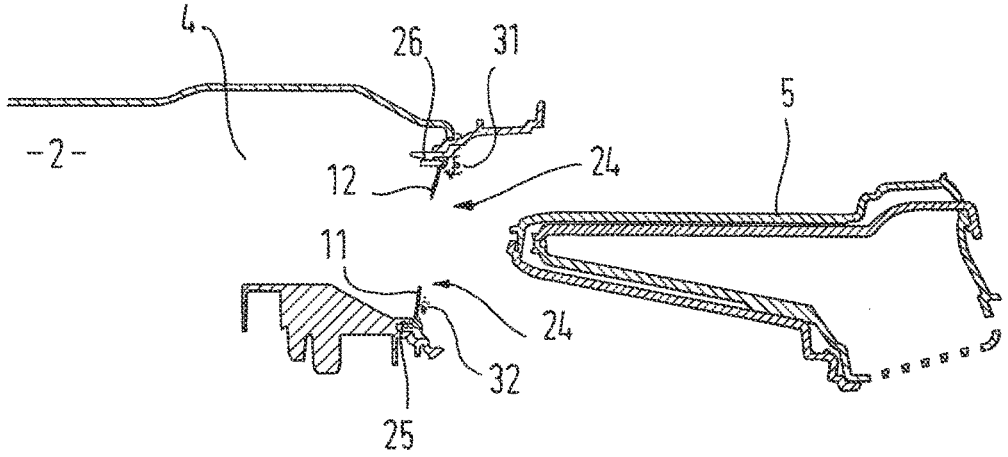

The invention is further explained below with reference to an exemplary embodiment shown in the enclosed drawing, in which:

FIG. 1 shows a cross-section of an accommodating device with the filter inserted, located in its operating position, FIG. 2 shows an enlarged view of the section A from FIG. 1, FIG. 3 shows the beginning of removal of the filter from the accommodating device and FIG. 4 shows the accommodating device with the filter removed.

FIG. 1 shows an accommodating device 1, which can for example be disposed in a process air duct 2 not shown in any greater detail of a tumble dryer not shown in any greater detail. To this extent the description below relates to a tumble dryer with a lint filter which can be disposed in the area of the upper process air duct in the end plate of a tumble dryer known per se (cf. for example DE 196 13 298 C1 cited at the start).

The device has an accommodating opening 4 for a removable lint filter 5. The filter 5 comprises, in a way known for example from the publications cited above, a filter material or a filter element, which filters out the said lint or contaminations, e.g. from the process air circuit of a tumble dryer. To this end the filter has an air inlet area 6 and an air outlet area 7 only indicated schematically.

In the situation shown in FIG. 1, the filter 5 is in its operating position, in which it is inserted into the accommodating opening 4 and is thus capable of filtering out lint from the process air. The area between filter 5 and accommodating opening 4 is sealed by a seal 9 located in a sealing operating position 8. The seal 9 has sealing elements 10 in the form of sealing lips 11, 12 for this purpose.

FIG. 2 shows, in an enlarged diagram, a section A from FIG. 1, in which the walling 14, 15 of the filter 5 can be seen. The sealing lip 12 of the seal 9 has made a close seal to the walling 15, so that the intermediate area between the accommodating opening 4 and the filter 5 is reliably sealed against the intrusion of lint or other foreign bodies.

FIG. 3 shows the beginning of the removal process of the filter 5 from the accommodating opening 4 by releasing the inlet area 16 of the accommodating opening 4. In this situation the sealing lips 11, 12—as indicated by arrows 21, 22—in an upwards hinging or pivoting movement, following the removal direction 23 of the filter 5, automatically move into a screening position 24. In the movement situation of the sealing lips 11, 12 depicted in FIG. 3 somewhat delayed (trailing) for reasons of presentation, these are just beginning to adjust themselves. This can especially be done by the inherent elasticity of the sealing lips 11, 12 in that said lips are made of an elastomer for example.

Through this the sealing lips 11, 12 are pre-tensioned by the inserted filter 5 in the operating position 8 depicted in the FIG. 1 against their inherent elasticity and then relax on removal of the filter 5 through their alignment and movement into the screening position 24.

The sealing lips 11, 12 can also be embodied as (elastically) unfoldable or hingable webs 25, 26 and reach the screening position 24 for example by a mechanical coupling with the removal movement of the filter 5 or by a separate spring element, for example an integrated leaf spring.

FIG. 4 shows the now completely hinged-out or unfolded sealing lips 11,12 or sealing webs 25, 26 after further removal of the filter 5 in the removal direction 23, which are now located completely aligned in the screening position 24. In the transitional area between the accommodating device or the accommodating opening 4 and the filter 5, any lint 31 or contaminations 32 present or accumulated are thus reliably prevented from falling into the accommodating opening 4 or into the process air duct 2 and can be manually removed in a simple manner. It is also conceivable to design the area of the accommodating opening or the sealing lips 11, 12 so that, on reinsertion of the filter 5, it is insured that by the insertion movement of the filter against the removal direction 23, lint or contaminations 31, 32 cannot be forced into the accommodating opening 4 or the process air duct 2.

With the embodiment of the accommodating device just described a reliable retention of lint and contamination in the area of the lint filter or the end plate and the accommodating opening is guaranteed. Thus an adverse effect on the operation of the device by lint, hairs or other contamination getting into the lint filter duct is reliably prevented. The filter lips or filter webs resting in a sealing manner in the operating position on the filter are embodied in this case and placed in relation to the accommodating opening so that, in the critical areas into which material can fall during removal of the filter, a preferably automatic alignment of these elements is undertaken such that they form a reliable screening or collection point for the lint and contamination. Especially preferably the seal 9 with the sealing lip (for example 12, cf.

FIG. 2) is embodied as a one-piece die-cast part or an extrusion part made from an elastomer. Especially preferably the seal 9 is embodied as a two-component part 40 (FIG. 2), wherein the sealing area 41 of the seal is manufactured from an elastomer 42 and the section of the seal used for attachment (installation area) 43 consists of a thermoplastic 44. This allows a simple and reliable latching by means of a latching element in the form of a latching lug 45 in the area of the accommodating opening 4.

REFERENCE CHARACTERS

1 Accommodating device
2 Process air duct
4 Accommodating opening
5 Lint filter
6 Air inlet area
7 Air outlet area
8 Operating position
9 Seal
10 Sealing element
11, 12 Sealing lips
14, 15 Walling
16 Inlet area
21, 22 Arrows
23 Removal direction
24 Screening position
25, 26 Webs
31 Lint
32 Contamination
40 Two-component part
41 Area
42 Elastomer
43 Sealing section
44 Thermoplastic
45 Latching lug

The invention claimed is:

1. An accommodating device for a removable filter, which is disposed in a process air duct of a domestic appliance, the accommodating device comprising an accommodating opening to at least partly accommodate the filter and with a seal which, with the filter inserted, seals the accommodating opening in relation to the filter, wherein the seal is disposed on an accommodating side and comprises at least one sealing element which, during removal of the filter, passes from a sealing operating position into a screening position, in which it surrounds at least one part of the accommodating opening in the manner of a screen, so that lint, hair or other contaminations or small items to be handled in the domestic appliance are securely prevented from falling into the accommodating opening.

2. The accommodating device as claimed in claim 1, wherein the sealing element has at least one hingable sealing lip.

3. The accommodating device as claimed in claim 1, wherein the sealing element has at least one elastic sealing lip which adjusts itself during removal of the filter.

4. The accommodating device as claimed in claim 1, wherein the seal is made at least partly of an elastomer.

5. The accommodating device as claimed in claim 1, wherein the seal is a two-component part, with a sealing element which consists of an elastomer and with an installation area which is made from another material.

6. The accommodating device as claimed in claim 5, wherein the installation area has at least one latching element with which the seal is fastened on the accommodating opening side.

7. The accommodating device as claimed in claim 1, wherein, when the filter is removed from the accommodating opening, the at least one sealing element is configured to automatically move from the sealing operating position into the screening position due to resiliency.

8. The accommodating device as claimed in claim 1, wherein the at least one sealing element is configured to automatically move from the screening position into the sealing operating position when the filter is inserted into the accommodating opening.

9. The accommodating device as claimed in claim 1, wherein the at least one sealing element is configured to pivot approximately 90° parallel to an accommodating opening axis and from the sealing operating position into the screening position perpendicular to the accommodating opening axis.

10. The accommodating device as claimed in claim 1, wherein the at least one sealing element is configured to pivot from the screening position into the sealing operating position.

11. The accommodating device as claimed in claim 1, wherein the at least one sealing element comprises a sealing lip, and when the at least one sealing element is in the sealing operating position, the sealing lip engages the filter.

12. An accommodating device for a removable filter positionable in a process air duct of a domestic appliance, the accommodating device comprising:

an accommodating opening configured to at least partly accommodate the filter, a seal, wherein, if the filter is inserted into the accommodating opening, the seal is configured to seal the accommodating opening in relation to the filter and is configured to engage opposite surfaces of the filter, wherein the seal is disposed on an accommodating opening side and comprises at least one sealing element, wherein the seal is configured to pass from a sealing operating position into a screening position during removal of the filter, wherein, in the screening position, the seal surrounds and screens at least one part of the accommodating opening so that contaminants to be handled in the domestic appliance are securely prevented from passing into the accommodating opening.

13. The accommodating device as claimed in claim 12, wherein the at least one sealing element has at least one hingable sealing lip.

14. The accommodating device as claimed in claim 13, wherein the at least one hingable sealing lip is configured to automatically pivot from the sealing operating position into the screening position.

15. The accommodating device as claimed in claim 12, wherein the at least one sealing element comprises a sealing lip, and when the at least one sealing element is in the sealing operating position, the sealing lip engages the filter.

16. The accommodating device as claimed in claim 12, wherein an installation area comprises at least one latching element configured to fasten the seal on an accommodating opening side.

17. A dryer comprising:

a removable filter disposed in a process air duct of the dryer, an accommodating opening configured to at least partly accommodate the filter, a seal, wherein, if the filter is inserted into the accommodating opening, the seal is configured to seal between a wall of the accommodating opening and the filter and is configured to engage opposite surfaces of the filter, wherein the seal is disposed on an accommodating opening side and comprises at least one sealing element, wherein the seal is configured to pass from a sealing operating position into a screening position during removal of the filter, wherein, in the screening position, the seal surrounds and screens at least one part of the accommodating opening so that lint, hair or other contaminations or small items to be handled in the domestic appliance are securely prevented from passing into the accommodating opening.

18. The dryer as claimed in claim 17, wherein the at least one seal comprises at least one hingable sealing lip configured to automatically pivot from the sealing operating position into the screening position.

19. The accommodating device as claimed in claim 1, wherein, if the filter is inserted into the accommodating opening, the seal is configured to engage opposite surfaces of the filter.

20. The accommodating device as claimed in claim 1, wherein the seal is a two-component part comprising a sealing lip made from an elastomer and an installation area which is made from a material different from that of the sealing lip, and wherein the sealing lip is disposed between a wall of the removable lint filter and the installation area when the filter is disposed in the accommodating opening.

21. The accommodating device as claimed in claim 1, wherein the seal is a two-component part comprising a sealing area made from an elastomer and an installation area which is made from a material different from that of the sealing area, and wherein the sealing area abuts the installation area.

22. The accommodating device as claimed in claim 12, wherein the seal is a two-component part comprising a sealing lip made from an elastomer and an installation area which is made from a material different from that of the sealing lip, and wherein the sealing lip is disposed between a wall of the removable lint filter and the installation area when the filter is deposed in the accommodating opening.

23. The accommodating device as claimed in claim 12, wherein the seal is a two-component part comprising a sealing area made from an elastomer and an installation area which is made from a material different from that of the sealing area, and wherein the sealing area abuts the installation area.

24. The dryer as claimed in claim 17, wherein the seal is a two-component part comprising a sealing lip made from an elastomer and an installation area which is made from a material different from that of the sealing lip, and wherein the sealing lip is disposed between a wall of the removable lint filter and the installation area when the filter is deposed in the accommodating opening.

25. The dryer as claimed in claim 17, wherein the seal is a two-component part comprising a sealing area made from an elastomer and an installation area which is made from a material different from that of the sealing area, and wherein the sealing area abuts the installation area.

* * * * *